United States Patent [19]

Jeschke et al.

[11] 4,344,610

[45] Aug. 17, 1982

[54] FOLDING APPARATUS FOR REEL OR WEB-FED ROTARY PRINTING MACHINES

[75] Inventors: Willi Jeschke, Heidelberg; Hans Müller, Leimen, both of Fed. Rep. of Germany

[73] Assignee: Heidelberger Druckmaschinen Aktiengesellschaft, Heidelberg, Fed. Rep. of Germany

[21] Appl. No.: 175,638

[22] Filed: Jul. 6, 1980

[30] Foreign Application Priority Data

Aug. 7, 1979 [DE] Fed. Rep. of Germany ..... 2931968

[51] Int. Cl.[3] ..... B41F 13/58

[52] U.S. Cl. ..... 270/6; 270/21.1; 270/47; 270/60; 493/432; 83/101; 83/346

[58] Field of Search ..... 270/4–6, 270/10, 428, 432, 13, 19, 38, 42, 47, 60; 83/101, 346; 493/428–432

[56] References Cited

U.S. PATENT DOCUMENTS

| | | | |
|---|---|---|---|
| 2,050,767 | 8/1936 | Seaman | 270/5 |
| 2,229,487 | 1/1941 | Barber | 493/429 X |
| 2,311,692 | 2/1943 | Potdevin | 83/101 |
| 3,528,367 | 9/1970 | Mumma | 101/425 X |
| 3,555,948 | 1/1971 | Olson | 83/346 |
| 4,036,487 | 7/1977 | Heimlicher | 493/428 |
| 4,073,485 | 2/1978 | Gregoire | 493/432 X |

FOREIGN PATENT DOCUMENTS

| | | | |
|---|---|---|---|
| 1611283 | 11/1975 | Fed. Rep. of Germany | 493/432 |
| 477979 | 10/1969 | Switzerland . | |
| 1213987 | 11/1970 | United Kingdom | 493/429 |

*Primary Examiner*—Edgar S. Burr
*Assistant Examiner*—A. Heinz
*Attorney, Agent, or Firm*—Herbert L. Lerner; Laurence A. Greenberg

[57] ABSTRACT

Folding machine in web-fed rotary printing machines for longitudinally folding, for cross-cutting the paper web and for collecting separated copies on a collecting cylinder cooperating with a knife cylinder, the collecting cylinder having an odd number of puncture rows on the periphery thereof, and the knife cylinder having an even number of puncture rows on the periphery thereof for the longitudinally folded paper web, the improvement therein including means defining the puncture rows firmly built into the collecting cylinder, cutting devices formed alternatingly of a single knife and a double knife respectively located on the knife cylinder following successive section length thereon, said single knife being disposed at a location whereat it leads the respective puncture row cooperating therewith and a device for removing from the puncture rows trimmed strips separated from the copies by the double knife on both sides.

8 Claims, 5 Drawing Figures

FOLDING APPARATUS FOR REEL OR WEB-FED ROTARY PRINTING MACHINES

The invention relates to a folding machine or apparatus for reel or web-fed rotary printing machines for longitudinally folding for cross-cutting the paper web and for collecting separated copies on a collecting cylinder cooperating with a knife cylinder, the collecting cylinder having an odd number of puncture rows on the periphery thereof, and the knife cylinder having an even number of puncture rows on the periphery thereof for the longitudinally folded paper web.

Heretofore known folding machines of this general type are normally referred to as fixed-format jaw and puncture-folding machines, respectively (periodical: "Der Polygraph," Book 13, 1954, pages 742–745, FIG. 5). The section lengths severed by the knives of the knife cylinder are taken over by controlled punctures on the collecting cylinder and, after the collection is completed, folded by a folding blade in the collecting cylinder and in a folding jaw on the jaw cylinder and from there, then for example over a paddle or bladed-wheel, delivered. These heretofore known folding machines are not capable of delivering completely cut products because the puncture perforations are present in the folded product and must be removed in a separate operation by cutting. It is also impossible to produce in the longitudinal fold four sides DIN A 4 in portrait or upright size or format with such heretofore known folding machines. The low production limit of such heretofore known folding machines is at eight sides uncut products.

Another heretofore known embodiment of a folding machine (German Pat. No. 16 11 283) discloses also a fixed-size or format folding machine with controlled grippers and a cutting device for the folded product. In this heretofore known folding machine, an additional cutting cylinder pair is provided and there is no possibility therein of collecting the copies.

In a heretofore known folding machine disclosed in Swiss Pat. No. 477 979, there is a variable gripper-folding apparatus wherein different section lengths can be cut, collected and folded. Such folding apparatus is considerably more complex and costly and are, therefore, used only on peripherally variable gravure rotary printing machines.

It is accordingly an object of the invention to provide a folding machine or apparatus where a paper web longitudinally folded by a longitudinally folding device, such as a funnel, for example, is cut into individual copies and collected and wherein the collected copies are delivered completely cut.

With the foregoing and other objects in view, there is provided, in accordance with the invention, a folding machine in web-fed rotary printing machines for longitudinally folding, for cross-cutting the paper web and for collecting separated copies on a collecting cylinder cooperating with a knife cylinder, the collecting cylinder having an odd number of puncture rows on the periphery thereof, and the knife cylinder having an even number of puncture rows on the periphery thereof for the longitudinally folded paper web, the improvement therein comprising means defining the puncture rows firmly built into the collecting cylinder, cutting devices formed alternatingly of a single knife and a double knife respectively located on the knife cylinder following successive section lengths thereon, the single knife being disposed at a location whereat it leads the respective puncture row cooperating therewith and a device for removing from the puncture rows trimmed strips separated from the copies by the double knife on both sides of the puncture rows.

In accordance with the principle of the invention, it is possible, for example, to deliver twice the amount of four side DIN A 4 in portrait or upright format, collected successively and completely cut.

It is possible, for example, to produce prospectus pages or leafs with four sides and a longitudinal fold completely cut, wherein the fiber direction in the upright format runs parallel to the longitudinal fold. Further advantages of the folding machine according to the invention are that with a relatively simple construction, a reliable and high production output is achieved.

Another advantage of the aforedescribed embodiment of the invention is that, in the collecting cylinder, no controlled punctures are provided so that a largely closed, hardened casing surface can be attained. By elminating the channels required for the puncture control, the cylinder can be manufactured practically without imbalance and can thereby operate largely free of vibration. Since no control forces for the puncture control can thus have any effect upon the cylinder body, the vibrations usually resulting therefrom are also avoided so that an exact cutting or severing of the paper web is assured.

In accordance with another feature of the invention, there is provided an adhesive-applying device for rhythmically applying an adhesive strip on the copies in vicinity of the edge of the elongated fold thereon on every second section length. With this feature of the invention, both four-sided, longitudinally folded DIN A 4 copies are mutually attached by adhesive so that an eight-sided product in upright format is produced.

In accordance with a further feature of the invention, there is provided a cross-folding device disposed downstream from the collecting cylinder and comprising a further, folding blade-folding jaw cylinder pair disposed downstream of said collecting cylinder-knife cylinder pair, a gripper row carried by said folding blade cylinder for gripping a copy fed thereto and taken over by the folding blade cylinder, a delivery belt disposed downstream from the folding jaw cylinder, and means for guiding the copy transversely folded by the folding blade and folding jaw cylinder pair to the delivery belt. This feature of the invention permits the production of a product with sixteen sides in DIN A 5 format and has a further advantage, accordingly, that with a cut-open edge of a longitudinal fold at the funnel and with a shut-down adhesive-applying device, a completely cut product likewise reaches the delivery.

In accordance with an added feature of the invention the collecting cylinder has a smooth hardened casing surface formed with slots spaced at given differences from one another about the periphery of the casing surface, puncture strips, respectively, received in the slots and formed with a plurality of bores, and puncture needles respectively disposed in a row within the respective bores.

In accordance with an additional feature of the invention the collecting cylinder is turnable with respect to the knife cylinder in accordance with the angular spacing of the slots, the puncture strips being accordingly transposable so as to be always located in the respective slots disposed opposite the knives of the knife cylinder during cooperation of the collecting cylinder and the knife cylinder.

In accordance with yet another feature of the invention the spacing between both knives of the double knife on the knife cylinder is variable.

In accordance with yet an additional feature of the invention, there are provided two clamping units mounted on the knife cylinder and being exchangeable as a whole, the clamping units including, besides the respective knives of the knife cylinder, also spacer strips and clamping rails, the knives being adjustable in the clamping units outside the folding machine.

In accordance with a concomitant feature of the invention puncture needles are received in bores disposed in the puncture rows, and the strip-removing device comprises a brush cleat for removing the trimmed strips from the puncture needles, the brush cleat being carried on a rotary support shaft revolving in opposite rotary direction from that of the collecting cylinder and having a lower peripheral velocity than that of the collecting cylinder.

These additional features of the invention assure a trouble-free and exact production of the completely process puncture-free delivered folded product.

Other features which are considered as characteristic for the invention are set forth in the appended claims.

Although the invention is illustrated and described herein as embodied in a folding apparatus for reel or web fed rotary printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
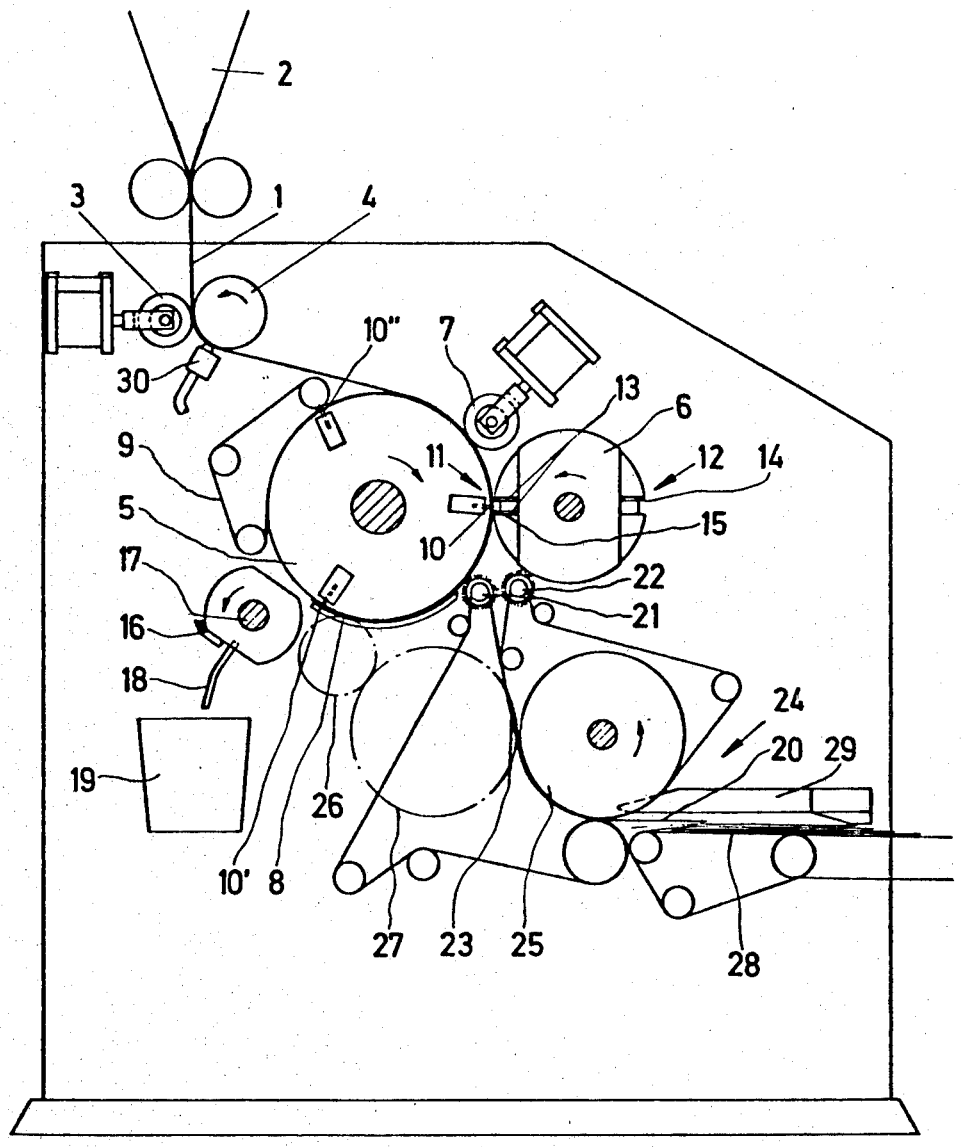
FIG. 1 is a diagrammatic side elevational view of a folding machine constructed in accordance with the invention.

Referring now to the drawing and first, particularly, to FIG. 1 thereof, there is shown a folding machine according to the invention, which uses a funnel 2 for longitudinally folding a paper web 1. The folded paper web 1 is fed through draw rollers 3 and 4 to a collecting cylinder 5 which cooperates with a knife cylinder 6. Feed or close-pressing rollers 7, tongues 8 and a belt guide 9 are provided at the collecting cylinder 5 for supporting or assisting the transport of the paper.

In the illustrated embodiment of FIG. 1, the periphery of the collecting cylinder 5 accommodates three format lengths so that, accordingly three rows 10, 10', 10'' of punctures are provided. The periphery of the knife cylinder 6 accommodates two format lengths so that two cutting devices 11, 12 are provided. In this regard, the cutting device 11 has a double knife 13 whereas the cutting device 12 is provided with a single knife 14.

Trimmed strips 15 separated by the double knife 13 on both sides of the puncture rows 10 are received by a brush strip or cleat 16 on a support shaft by rotating in opposite rotary direction than that of the collecting cylinder 5 and fed by wipers or strippers 18 to a container of vessel 19.

The trimmed and collected copies 20 are fed over the brush rollers 21, 22 and the belt guide 23 to a delivery 24. A drum 25, driven through the intermediate wheels 26 and 27 serves, in turn, for driving the belt guide 23. The individual copies 20 are deposited overlappingly i.e. in a fish-scalelike manner, on a delivery belt 28 and carried away. Guide tongues 29 are provided above the delivery belt 28.

An adhesive-applying device 30 is coordinated with the draw roller 4 and rhythmically i.e. cyclically, applies an adhesive strip onto each second section length in vicinity of the longitudinal-fold edge, so that both the collection copies mutually adhere over the adhesive strips, after the cutting.

Figure 2:
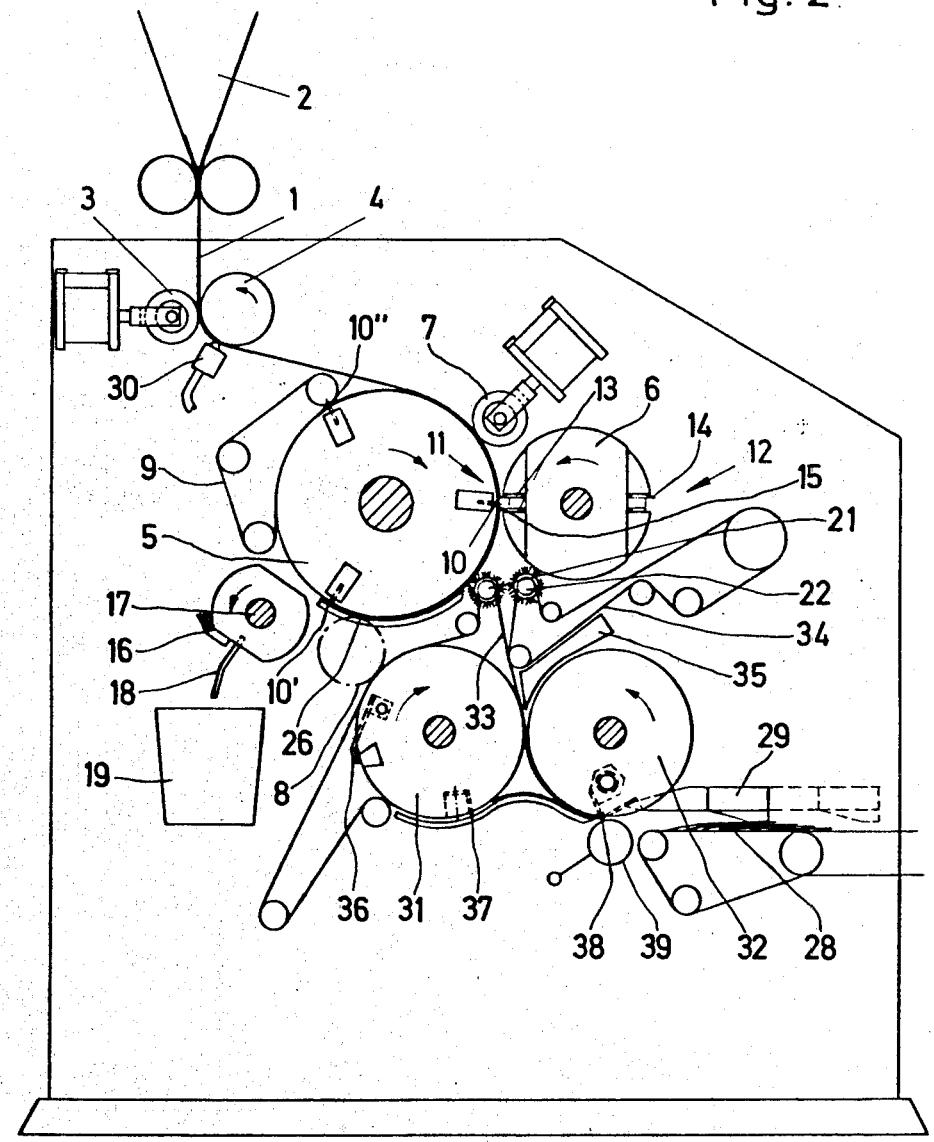
FIG. 2 is a another view of FIG. 1 showing the folding machine with an additional cross-folding device.

The embodiment of FIG. 2 differs from the hereinaforedescribed embodiment of FIG. 1 in that in the device for the delivery a chopper or folding blade cylinder 31 and a folding jaw cylinder 32 are disposed after the collecting cylinder 5 and the knife cylinder 6. A belt guide 33 slung around the brush roller 21, and a belt guide 34 slung around the brush roller 22 feed the collected copies, coordinated by a tongue 35, to a gripper row 36 of the folding knife cylinder 31. The latter takes over the copy by its end and entrains it in a rotary direction of the folding blade cylinder 31 until the folding blade or chopper 37 tucks in or presses the middle of the copy between the folding jaws 38. They accordingly fold the copy and feed it in rotary direction of the folding jaw cylinder 32 to the delivery belt 28. Thereat, the folded copy is raised by the guide tongues out of the folding jaws 38 and deposits fish-scalelike i.e. overlappingly. Rollers 39 are provided for aiding in the deposition of the folded copy. If the paper web 1, in this embodiment of FIG. 2, is cut open at the point or apex of the funnel and the adhesive-applying device 30 is shut down, a completely cut folded product in DIN AS format with sixteen sides is then produced.

Figure 3:
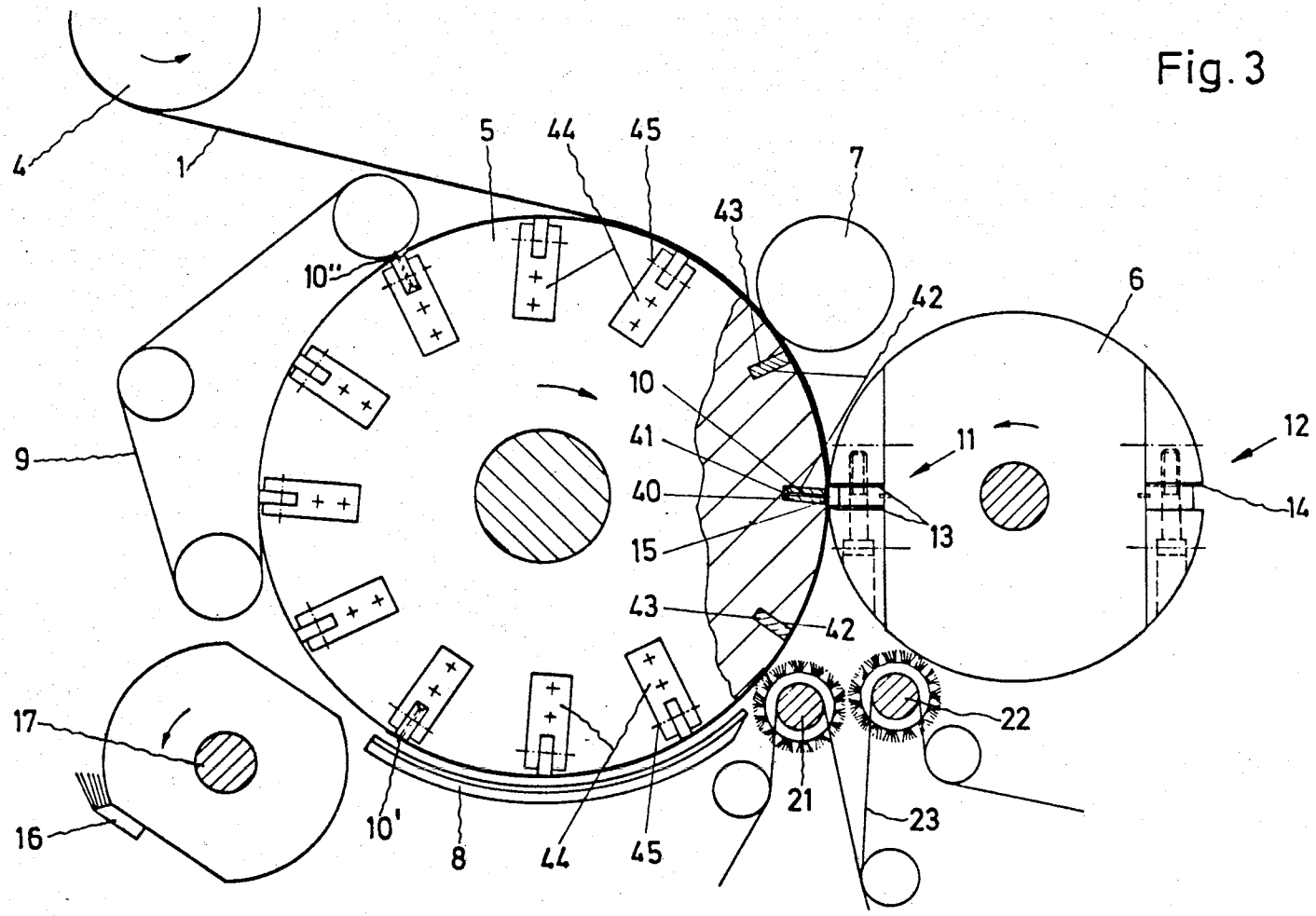
FIG. 3 is an enlarged fragmentary view of FIG. 2 showing a cutting-collecting cylinder pair forming part of the machine according to the invention.

In the enlarged fragmentary view of FIG. 3, it is apparent that the puncture rows 10, 10', 10'' are formed in firmly fastened puncture strips or cleats 40 provided with bores into which, in turn, puncture needles 41 are inserted. The collecting cylinder 5 has a smooth hardened casing surface, wherein slots 42 are provided at a given space from one another, the puncture strips 40 being received in the respective slots 42 and being offset from one another by a peripheral angle of 120°. In the illustrated embodiment, additional slots 42 are provided in the casing of the cylinder 5 which are mutually offset by peripheral angles of 30°, the puncture strips 40 being also receivable therein. It is accordingly possible, with this embodiment of FIG. 3, to mutually offset the three puncture rows, 10, 10', 10'' by angles Of 30° about the circumference of the cylinder and to turn the cylinder 5 accordingly with respect to the knife cylinder 6 so that the puncture strips 40 are always disposed in the slots 42 located opposite the knives 13 of the knife cylinder. When wear of the casing surface of the collecting cylinder 5 occurs in vicinity of the knives 13, 14, the collecting cylinder 5 can be turned through 30° so that a new surface of the cylinder casing cooperates with the knives 13, 14. The slots 42 which are not needed may be filled in with suitable filling members 43. Both the puncture strips 40 as well as the filler members 43 are fastened to holders 44 which are, respectively, screwed tightly to both end faces of the collecting cylinder 5. Fastening of the puncture strips 40 and filling members 43, respectively, is effected by means of screws 45 to the holders 44.

A separated individual copy guided by the puncture row 10' and covering about 120° of the peripheral casing surface of the collecting cylinder 5 is shown in the embodiment of FIG. 3, as viewed in rotary direction of the collecting cylinder 5, forward of the cutting device 11. In the next 120° section, no copy is present on the puncture row 10' and, in the last 120° section, downstream of the cutting device 11, as viewed in rotary direction of the collecting cylinder 5, a collecting copy is shown superimposed upon a previously existing copy and is taken over by the puncture row 10 and, after a turn of about 120°, is severed by the cutting device 12. The last-described two copies are removed as collecting product by the brush rollers 21, 22.

For collecting, it is essential that the collecting cylinder 5 have an odd number of punctured rows installed in the cylinder 5 which, in the illustrated embodiment, are firmly or fixedly mounted therein. In contrast thereto, the knife cylinder 6 has an even number of cutting devices 11 for the longitudinally folded paper web.

Figure 4:
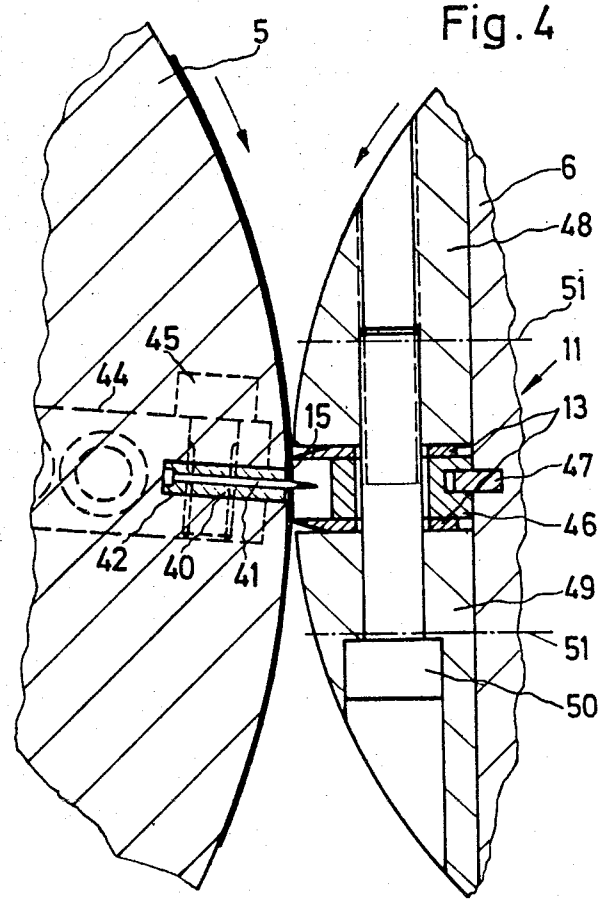
FIG. 4 is an enlarged fragmentary view of FIG. 3 showing the cylinder pair in the cutting phase with a double knife.

In FIG. 4, a spacer strip 46 is provided between the double knives 13 and is centered by a centering member 47 on the body of the knife cylinder 6. Clamping rails 48 and 49 are provided on both sides of the double knife 13 and is accommodated or matched with the outer surface thereof to the knife cylinder 6. By means of screws 50, both clamping rails 48, 49 are able to be braced with respect to one another, whereby the double knife 13 is also held. Both two clamping rails 48 and 49 as well as the double knife and the spacer strip 46 form a unit which can be oriented or aligned and adjusted outside the knife cylinder 6. The height or level of the double knife 13 is thereby especially able to be adjusted with great accuracy. The unit formed by the double knife 13 and the spacer strip 46 is itself then able to be fastened by means of screws 51 to the body of the knife cylinder 6. It is thereby possible, by employing spacer strips 46 of different width, to vary the spacing between the two blades of the double knife 13.

Figure 5:
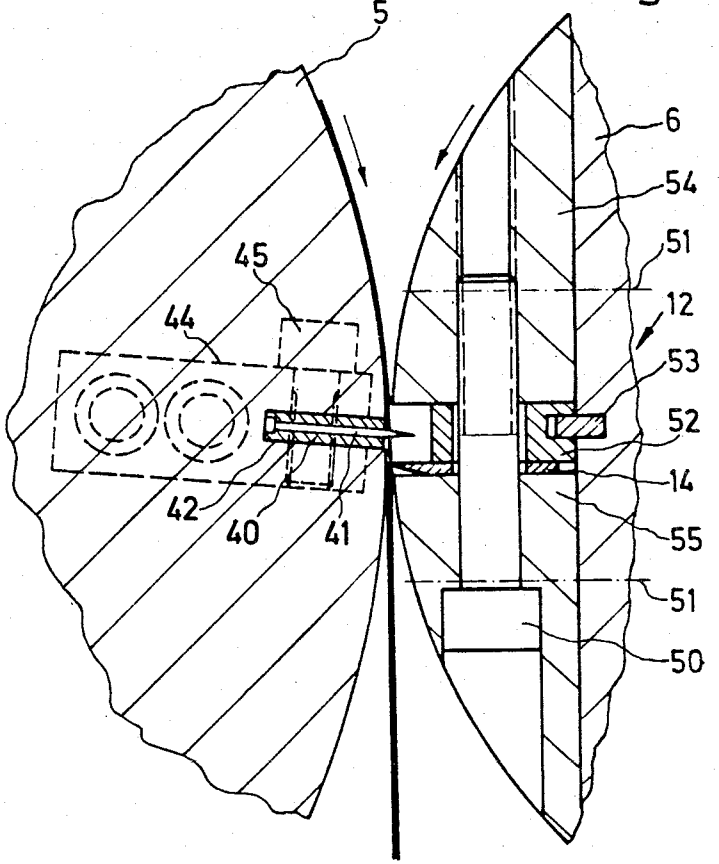
FIG. 5 is another enlarged fragmentary view of FIG. 3 similar to that of FIG. 4 and showing the cylinder pair in the cutting phase, however with a single knife.

The embodiment of FIG. 5 differs from that of FIG. 4 in that a single knife 14 is provided therein adjacent to a spacer strip 52 which also accommodates a centering member 53. In this case, too, the single or individual knife 14 with the spacer strip 52 and two clamping rails 54, 55 are able to be braced, through the screws 50. Setting, adjustment and fastening of the unit of FIG. 5 is effected in a manner exactly as described hereinbefore with respect to the embodiment of FIG. 4.

If a double knife 13 should also be installed on the knife cylinder 6 instead of the single or individual knife 14, so that two double knives are provided, then every longitudinally folded copy can be fed to the delivery in DIN A4 format with four sides i.e. double the production can be effected, which, for example, can also be apportioned by two cooperating oppositely rotating paddle or bladed wheels in two separate lines or flows. It is thereby possible to produce separately two different DINA 4 copies in upright or portrait size or format with, respectively, four sides.

A further advantage of the hereinaforedescribed embodiment of the invention shown in FIG. 5 is that, in the collection cylinder 6, no controlled punctures are provided so that a largely closed, hardened casing surface can be attained. By elimination of the channels and recesses required for puncture control, the cylinder can be manufactured virtually without imbalance and, consequently, can operate free of vibrations. Since no control forces for the puncture control can thus have any effect upon the cylinder body, the vibrations usually resulting therefrom, are also avoided so that an exact reversing of the paper web is assured.

There are claimed:

1. Folding machine in web-fed rotary printing machines for longitudinally folding a paper web, for cross-cutting the thus longitudinally folded paper web and for collecting separated copies on a collecting cylinder cooperating with a knife cylinder, the cylinders having respectively parallel axes disposed in a common plane and being disposed substantially tangentially to one another, the collecting cylinder having an odd number of puncture rows on the periphery thereof for securing the paper web to the collecting cylinder and the knife cylinder having an even number of cutting rows spaced about the periphery thereof for securing the paper web to the collecting cylinder and the knife cylinder having an even number of cutting rows spaced about the periphery thereof for cutting the paper web into page-length segments, the cylinders being rotatable in opposite rotary directions, the improvement therein comprising means defining the puncture rows firmly built into the collecting cylinder, said cutting rows formed alternatingly of a single knife for making a single cut in said web at one end of a page-length segment and a double knife for making two substantially simultaneous cuts in said web at an opposite end of said page-length segment, said single knife being disposed at a location whereat it leads the respective puncture row on the collecting cylinder cooperating therewith and a device for removing from the puncture rows trimmed strips separated from the copies by said double knife on both sides of the puncture rows.

2. Folding machine according to claim 1 including an adhesive-applying device for rhythmically applying an adhesive strip on the copies in vicinity of the edge of the longitudinal fold formed thereon on every second section length.

3. Folding machine according to claim 1 including a cross-folding device disposed downstream from said collecting cylinder and comprising a further, folding blade-folding jaw cylinder pair disposed downstream of said collecting cylinder-knife cylinder pair, a gripper row carried by said folding blade cylinder for gripping a copy fed thereto and taken over by said folding blade cylinder, a delivery belt disposed downstream from said folding jaw cylinder, and means for guiding the copy transversely folded by said folding blade and folding jaw cylinder pair to said delivery belt.

4. Folding machine according to claim 1 wherein said collecting cylinder has a smooth hardened casing surface formed with slots spaced at given distances from one another about the periphery of said casing surface, puncture strips, respectively received in said slots and formed with a plurality of bores, and puncture needles, respectively disposed in a row within the respective bores.

5. Folding machine according to claim 4 wherein said collecting cylinder is turnable with respect to said knife cylinder in accordance with an angular spacing of said slots, said puncture strips being accordingly transposable so as to be always located in the respective slots disposed opposite the knives of the knife cylinder during cooperation of said collecting cylinder and said knife cylinder.

6. Folding machine according to claim 5 wherein the double knife is formed with two knives having a variable spacing therebetween on said knife cylinder.

7. Folding machine according to claim 1 including two clamping units mounted on said knife cylinder and being exchangeable as a whole, said clamping units including, besides the respective knives of the knife cylinder, also spacer strips and clamping rails, said knives being adjustable in said clamping units outside the folding machine.

8. Folding machine according to claim 1 wherein puncture needles are received in bores disposed in said puncture rows, and said strip-removing device comprises a brush cleat for removing the trimmed strips from said puncture needles, said brush cleat being carried on a rotary support shaft rotatable in opposite rotary direction from that of said collecting cylinder and having a lower peripheral velocity than that of said collecting cylinder.

* * * * *